United States Patent [19]

Ikeura et al.

[11] Patent Number: 4,732,126

[45] Date of Patent: Mar. 22, 1988

[54] FUEL CONTROL SYSTEM FOR INTERNAL COMBUSTION ENGINES

[75] Inventors: Kenji Ikeura, Zushi; Yoshihisa Kawamura, Yokosuka; Takeshi Atago; Yasunori Mouri, both of Katsuta, all of Japan

[73] Assignees: Hitachi, Ltd.; Nissan Motor Co., Ltd., both of Japan

[21] Appl. No.: 46,401

[22] Filed: May 6, 1987

[30] Foreign Application Priority Data

May 10, 1986 [JP] Japan ..... 61-105843

[51] Int. Cl.[4] ..... F02M 51/00

[52] U.S. Cl. ..... 123/435; 123/480

[58] Field of Search ..... 123/425, 435, 478, 480, 123/486

[56] References Cited

U.S. PATENT DOCUMENTS

| | | | |
|---|---|---|---|
| 4,356,551 | 10/1982 | Iwase et al. | 123/435 X |
| 4,549,513 | 10/1985 | Douaud et al. | 123/435 X |
| 4,561,401 | 12/1985 | Hata et al. | 123/435 X |
| 4,606,312 | 8/1986 | Nakano et al. | 123/435 X |

FOREIGN PATENT DOCUMENTS

| | | | |
|---|---|---|---|
| 0018267 | 1/1984 | Japan | 123/435 |
| 0016266 | 1/1986 | Japan . | |
| 0016269 | 1/1986 | Japan . | |
| 0016271 | 1/1986 | Japan . | |

*Primary Examiner*—Willis R. Wolfe

*Attorney, Agent, or Firm*—Antonelli, Terry & Wands

[57] ABSTRACT

A basic pulse width $T_p$ is determined in accordance with the throttle valve opening and speed of an engine, and the basic pulse width $T_p$ is corrected when the peak value of cylinder pressures exceeds a given range established by the average value of the peak pressure values.

1 Claim, 14 Drawing Figures

FUEL CONTROL SYSTEM FOR INTERNAL COMBUSTION ENGINES

BACKGROUND OF THE INVENTION

1. Field of the Invention

The present invention relates to a fuel control system for internal combustion engines.

2. Description of the Prior Art

The control of fuel injection in an engine has heretofore been effected by the injectors which are opened in synchronism with the rotation of the engine and whose valve opening time $T_i$ is controlled in accordance with the input parameters. The known control methods of the type based on the input parameters may be divided into the following three broad classes. Note that there are many instances in which the actual control is performed by the use of a microcomputer. The microcomputer is provided with a microprogram and a variety of processes such as inputting operations, computational operations and outputting operations in accordance with the microprogram. Also, the principal methods which have been used for controlling the valve opening time $T_i$ are, as follows: (i) the method employing the manifold pressure and the engine speed as the principal parameters, (ii) the method employing the intake air flow and the engine speed as the principal parameters, and (iii) the method employing the throttle opening and the engine speed as the principal parameters.

Further, included among known methods improved on the basis of these three methods is one which adds the angle of peak cylinder pressure to the method of (ii) employing the intake air flow and the engine speed as the principal parameters.

The known methods of this type utilizing the detection of the angle of peak cylinder pressure are disclosed in Japanese Patent Laid-open (JP-A) Nos. 61-16269, 61-16271 and 61-16266.

These known methods are each used in accordance with its intended application. In particular, the control method mentioned in (iii) makes it prerequisite to detect the throttle opening and thus it has the advantages of being high in response and excellent in transient characteristic. However, there is a disadvantage that at low engine speeds, the engine comes into the full load operation with the reduced throttle opening and therefore the resulting accuracy is decreased. At this time, there exists a given relation between the engine speed and the throttle opening.

On the other hand, as regards the requirements of the engine, there is a desire for a lean combustion operation. The methods designed to meet this requirement are referred to as the lean combustion type. The lean combustion type has the effect of improving the fuel consumption and improving the exhaust emission control performance.

The fuel injection method must be low in cost and high in performance. While the control method of the above (iii) is excellent for this purpose, it has the previously mentioned deficiencies.

Also, where the lean combustion operation is effected, there exists a stable combustion limit and exceeding this limit causes the rotation of the engine to become unstable.

SUMMARY OF THE INVENTION

It is an object of the present invention to provide a fuel control apparatus for an internal combustion engine which combines a fuel injection control method of the throttle opening detection type and a correction method based on the angle of peak cylinder pressure.

To accomplish the above object, in accordance with the invention there is thus provided a fuel control system for an engine including means for computing a basic injection pulse width $T_p$ from the throttle opening and speed of the engine, and means for computing an injector energization time $T_i$ from the pulse width $T_p$, a correction factor K and a correction factor determined by the peak cylinder pressure angle $\theta_{pmax}$.

DESCRIPTION OF THE PREFERRED EMBODIMENTS

Prior to the description of the present invention, the previously mentioned prior art control methods will be described first and those shown in block form can be replaced with the equivalent control steps of a computer.

(i) The method employing the manifold pressure and the engine speed as the principal parameters.

Figure 1:
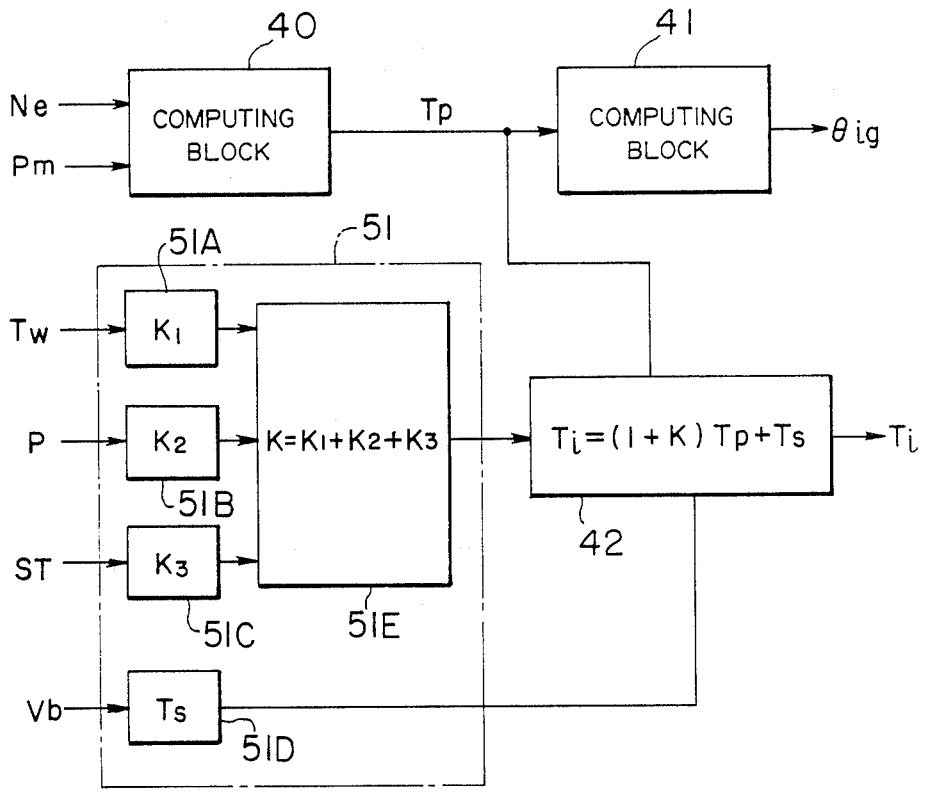
FIG. 1 PRIOR ART
FIGS. 1 to 4 show prior art fuel control methods.

FIG. 1 shows control blocks for this method. A computing block 40 inputs the engine speed $N_e$ and the manifold pressure $P_m$ and computes a basic injection pulse width $T_p$ from $T_p=f(N_e, P_m)$. A correction factor computing block 51 determines correction factors $K_1$, $K_2$ and $K_3$ with respect to the cooling water temperature $T_w$, the start signal ST from the starter switch and the idle position P of the throttle valve through blocks 51A to 51C, respectively, and a correction factor K is computed by a block 51E from the following equation $$K=K_1+K_2+K_3 \quad (1)$$

A block 51D computes a correction time $T_s$ from the battery voltage $V_b$.

A computing block 42 inputs the values of $T_p$ and K and computes an injector energization time $T_i$. The following expression is used for this computation $$T_i=(1+K)T_p+T_s \quad (2)$$

Figure 2:
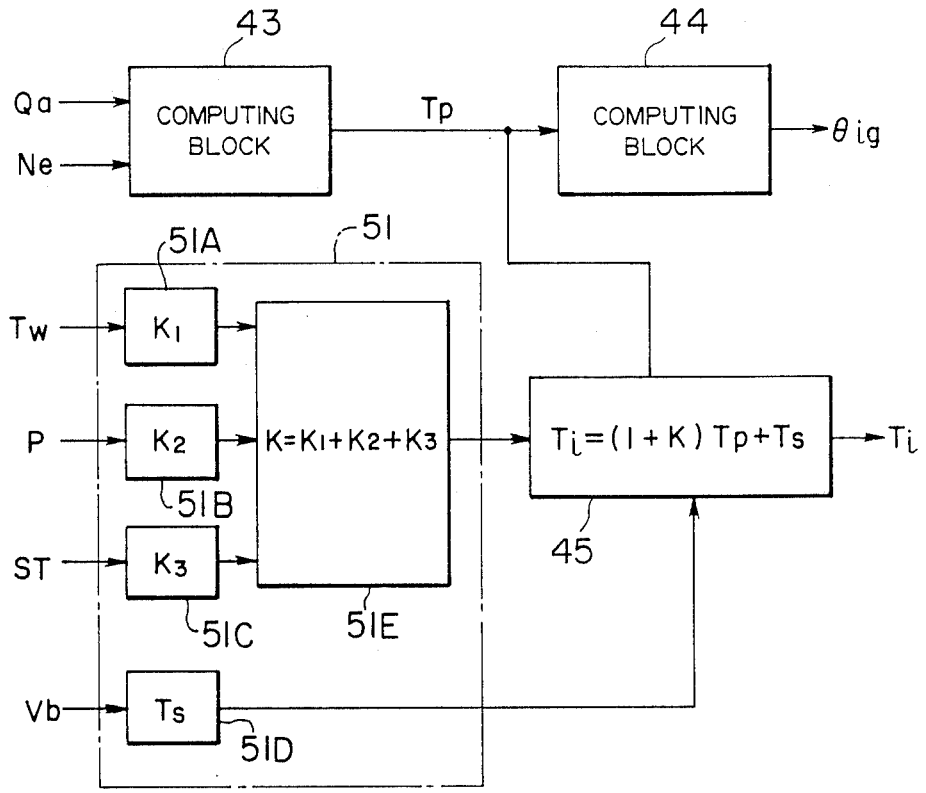
FIG. 2 PRIOR ART

(ii) The method employing the intake air flow and the engine speed as the principal parameters:

FIG. 2 shows control blocks for this method. A computing block 43 inputs the intake air flow $Q_a$ and the engine speed $N_e$ to compute a basic injection pulse width $T_p$. The intake air flow $Q_a$ is detected by an air flow sensor. The expression for the calculation of $T_p$ is as follows $$T_p=Q_a/N_e \quad (3)$$

Computing blocks 51A to 51C and 51E calculate a correction factor K in the same manner as equation (1) and then a correction is provided by a computing block 45 in accordance with equation (2).

Figure 3:
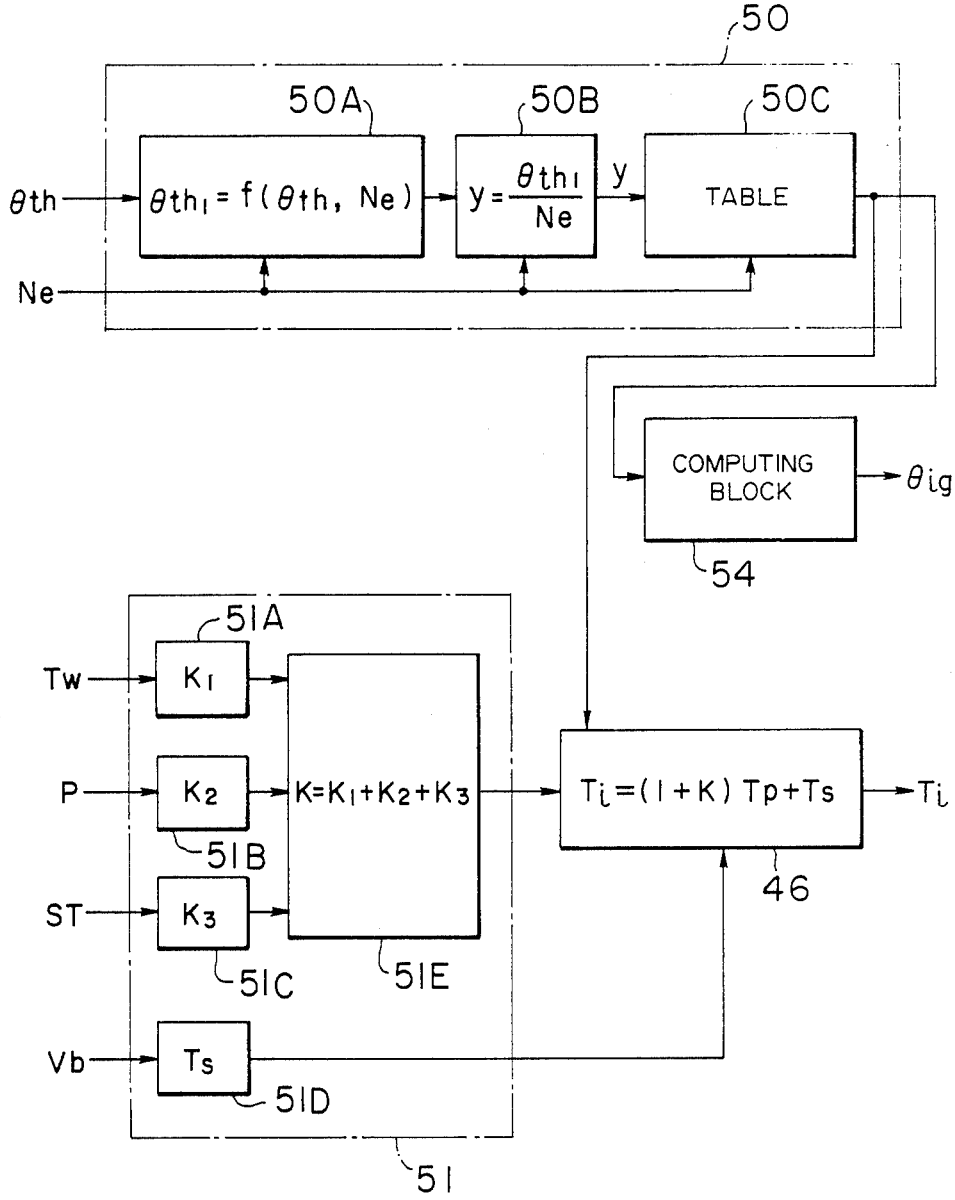
FIG. 3 PRIOR ART

(iii) The method employing the throttle opening and the engine speed as the principal parameters:

FIG. 3 shows control blocks for this method. In a computing block 50, a block 50A performs the initialization to determine the value of the throttle opening $\theta_{th1}$ and then a block 50B determines the value of $y=\theta_{th1}/N_e$ from the throttle opening $\theta_{th1}$ and the engine speed $N_e$. Then, using the values of y and $N_e$ as an address, a table 50C containing the values of $T_p$ as data is accessed to read the time width $T_p$ corresponding to the then current y and $N_e$.

A computing block 46 calculates the value of $T_i$ in accordance with equation (2).

Also, the other method of the type employing the angle of peak cylinder pressure as a correction parameter performs the following control.

Figure 4:
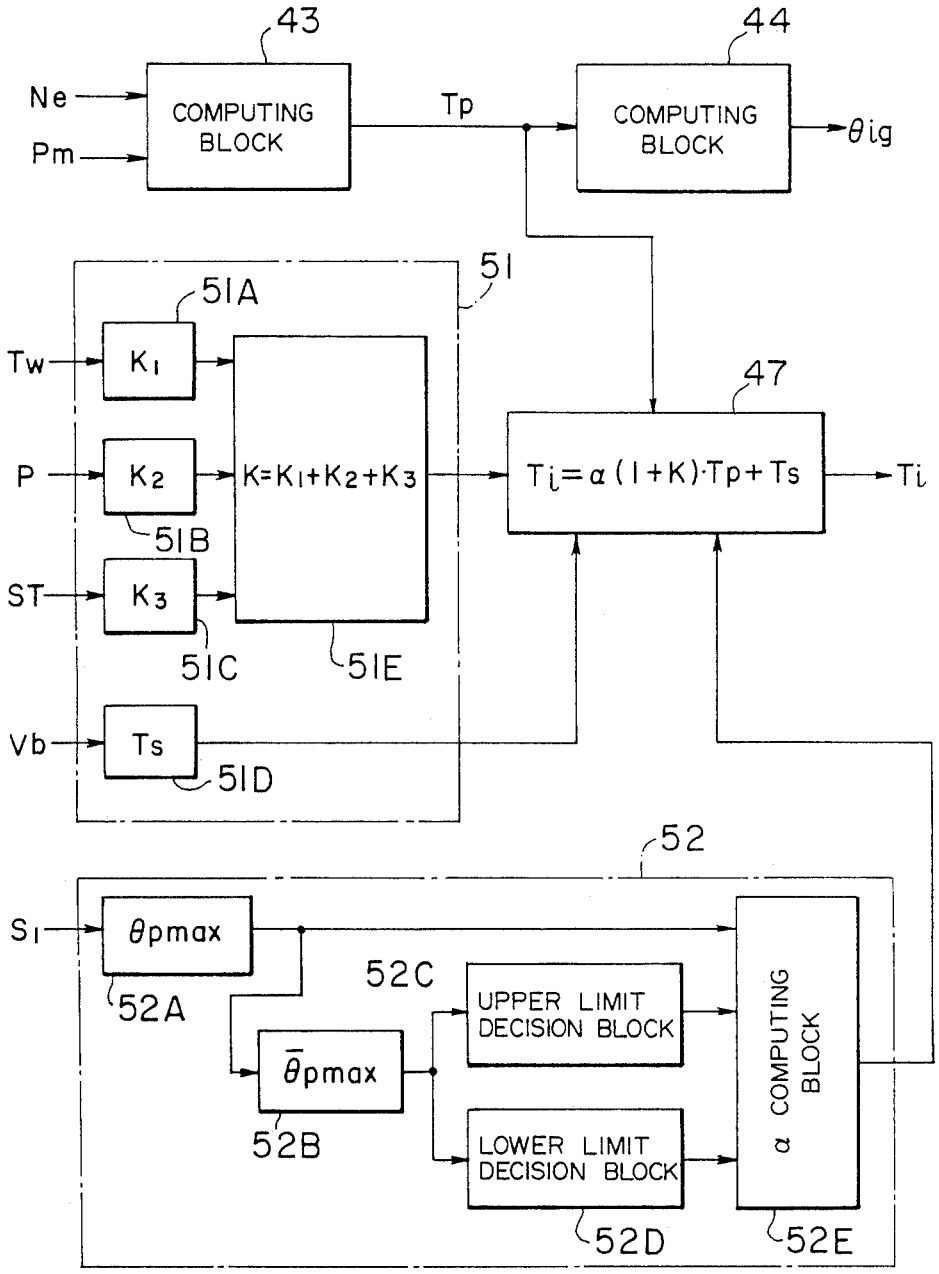
FIG. 4 PRIOR ART

Referring to FIG. 4, a block 52A of a computing block 52 monitors the detection values of a cylinder pressure sensor to successively determine the values of peak angle $\theta_{pmax}$. In addition, a block 52B produces the average value of the peak angles and it is determined whether each peak pressure $\theta_{pmax}$ is within a tolerance $\Delta\theta$ as compared with the average value $\overline{\theta}_{pmax}$ (blocks 52C and 52D). If the resulting difference is within the tolerance $\Delta\theta$, a block 52E outputs a correction factor $\alpha$ without changing it. If the resulting difference is outside the tolerance, a given value is subtracted from the value of $\alpha$ and the result is outputted when the difference is greater than $+\Delta\theta$, whereas a given value is added to the value of $\alpha$ and the result is outputted when the difference is less than $-\Delta\theta$. The output of the computing block 52 is referred to as an $\alpha$.

A computing block 47 calculates the values of $T_i$ from the following equation $$T_i=\alpha(1+K)T_p \quad (4)$$

These prior art methods have involved the previously mentioned deficiencies and have not been desirable.

A preferred embodiment of the invention will now be described.

Figure 5:
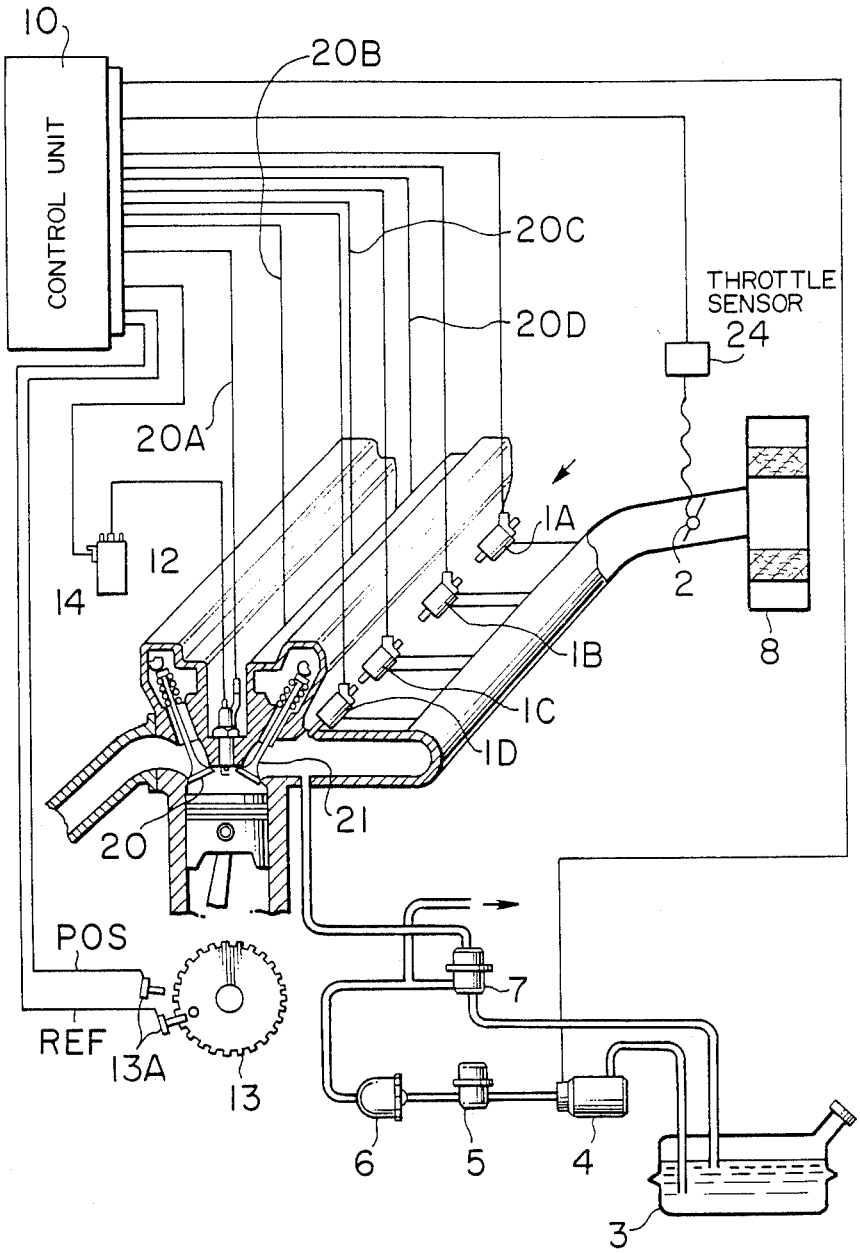
FIG. 5 is a diagram showing an application of the invention.

Referring to FIG. 5, there is illustrated the control system of an engine to which the invention is applied. Assume that the engine has four cylinders (No. 1 to No. 4). The engine is supplied with fuel through injectors 1A to 1D which are arranged in correspondence to the cylinder and also air is supplied to the engine through a throttle valve 2.

The fuel supply to the injectors 1A to 1D is effected through a fuel tank 3, a pump 4, a damper 5 and a filter 6. The fuel pressure by a fuel pressure regulator 7 is subjected to vacuum regulation.

The throttle valve 2 is operated in association with the accelerator pedal to draw in the air. The air supply to the throttle valve 2 is effected through an air cleaner 8.

A control unit 10 includes a computer as its principle component to perform various monitoring and control operations. The control operations to be performed include the fuel control the ignition timing control, etc. For these monitoring and control operations, various operating parameters of the automobile are taken in. These operating parameters are each detected by a sensor.

The types of sensors and the corresponding operating parameters are as follows.

Combustion pressure sensors 12 . . . These sensors detect the combustion pressures. The sensors are each provided for one of the cylinders. In the Figure, only one of these sensors is shown. Leads 20A to 20D are respectively provided as output leads for the sensors.

Crank angle sensors 13A . . . These sensors monitor the rotation of a ring gear 13 coupled to the crankshaft to respectively detect angle signals (POS) and cylinder signals (REF).

A throttle sensor 24 . . . This sensor detects the opening of the throttle valve 2.

An accelerator position sensor . . . This sensor detects the amount of depression of the accelerator pedal.

An idle switch . . . This switch detects the idling condition.

A water temperature sensor . . . This sensor detects the temperature of the engine cooling water.

A battery voltage detecting system . . . This system detects the battery voltage.

The detected values of these sensors (switches) are applied to the control unit 10 which in turn performs the various monitoring and computational operations as well as the various controls. The contents of these operations and controls are as follows.

The injectors 1A to 1D . . . An opening command for the injector on each cylinder is computed, thereby operating the injectors 1A to 1D.

An ignition coil 14 . . . The proper timing of ignition is computed to control the ignition timing. There are two cases where the coil is provided for each of the cylinders and where only the single coil is provided to serve all the cylinders.

The fuel pump 4 . . . The operation of this fuel pump is controlled.

Figure 6:
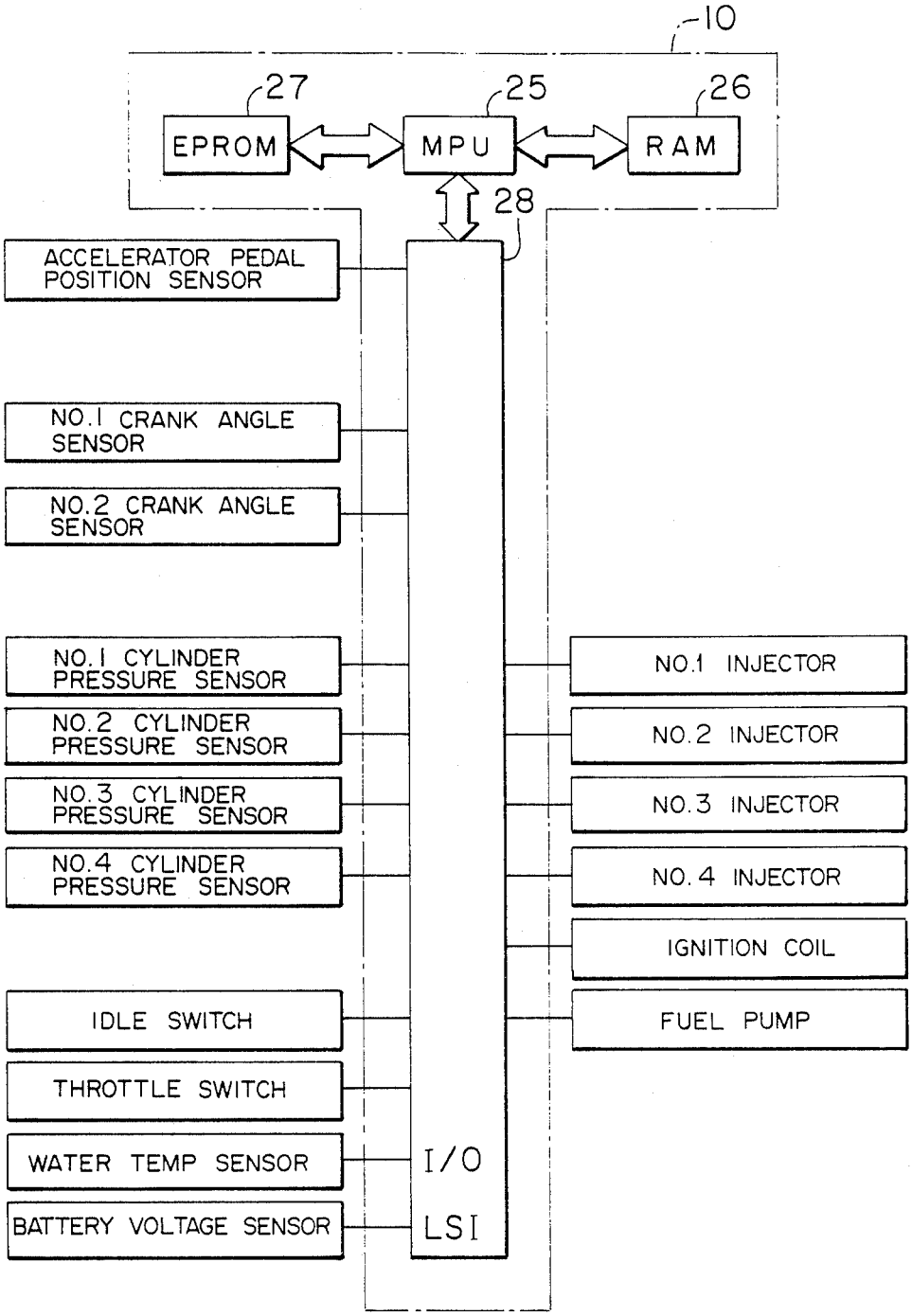
FIG. 6 is a block diagram of the processing system.

Referring to FIG. 6, there is illustrated a block diagram of the monitor and control system mainly composed of the control unit 10. The control unit 10 includes a microprocessor (MPU) 25, a read-only memory (ROM) 27, a random access memory (RAM) 26 and an input/ output interface 28.

The MPU 25 receives the operating conditions of the sensors and switches through the input/output interfaces 28, performs the necessary monitoring and processing operations in accordance with the program in the ROM 27 and sends the corresponding outputs to the units to be controlled (the actuators, injectors, ignition coil, etc.), thereby controlling the units.

Figure 7:
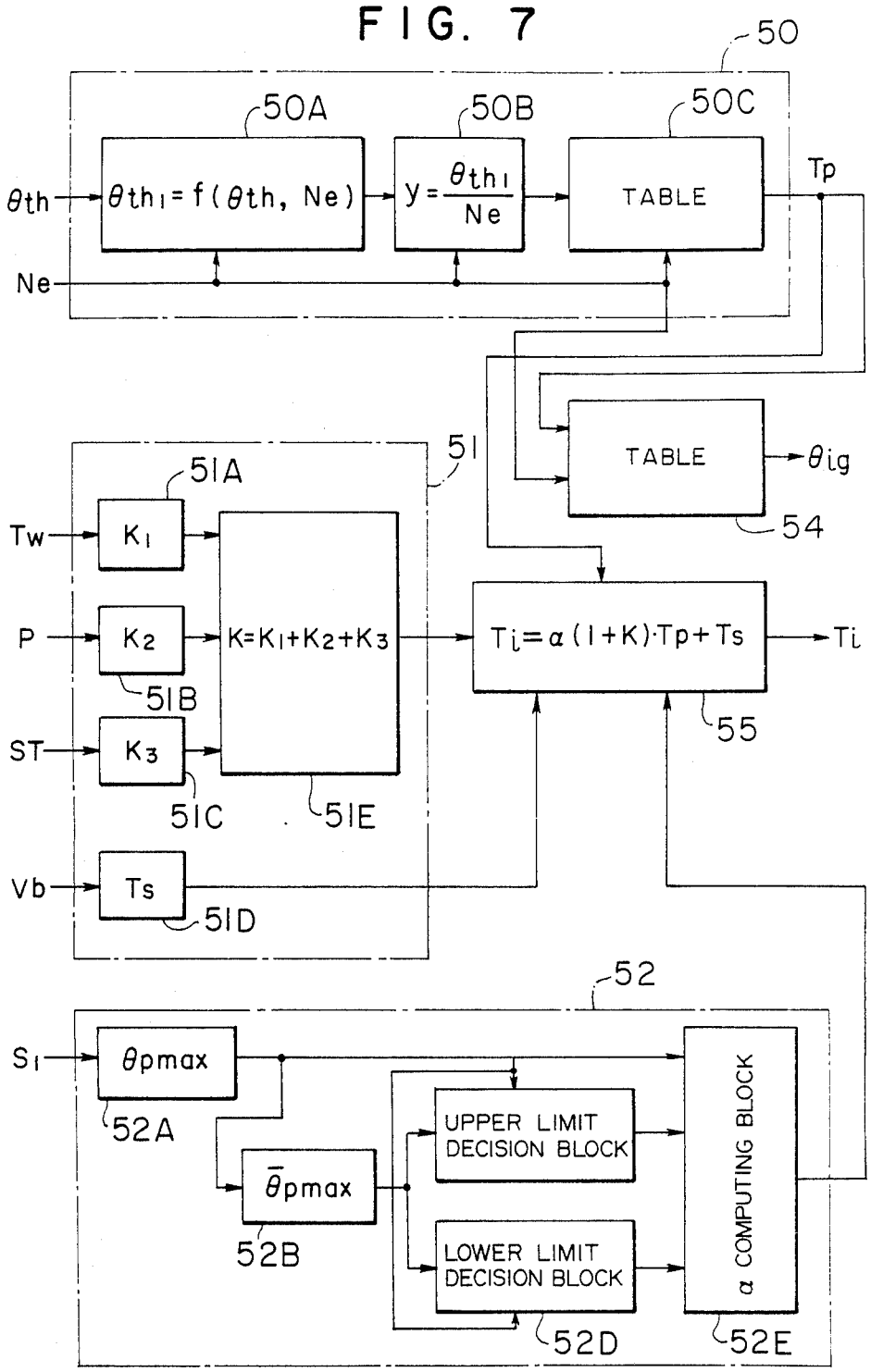
FIG. 7 is a block diagram showing an embodiment of the invention.

FIG. 7 is a block diagram showing an embodiment of the invention which is applied to the processings in the control unit 10, particularly the fuel control processing. A computing block 50 includes a block 50A for inputting and linearizing the detected throttle valve opening $\theta_{th}$ and the engine speed $N_e$ detected by the crank angle sensor. If $\theta_{th1}$ represents the linearized throttle opening, the block 50A determines as follows $$\theta_{th1}=f(\theta_{th},N_e) \quad (5)$$

Then, a block 50B divides the linearized throttle opening $\theta_{th1}$ by the engine speed $N_e$ to calculate a value y which substantially corresponds to the load $$y=\theta_{th1}/N_e \quad (6)$$

A table 50C uses engine speeds N and values y as addresses and its data represent basic injection pulse widths $T_p$. Thus, by applying the value y determined from equation (6) and the engine speed $N_e$, the corresponding basic injection pulse width $T_p$ is obtained.

The basic injection pulse width $T_p$ is applied as an address for a table 54 and it is also applied as an input to a computing block 55. The table 54 stores the values of $T_p$ and $N_e$ as addresses and ignition timings $\theta_{ig}$ as data. Thus, by applying the pulse width $T_p$ from the block 50 and the engine speed $N_e$, the corresponding ignition timing $\theta_{ig}$ is read out.

Figure 8:
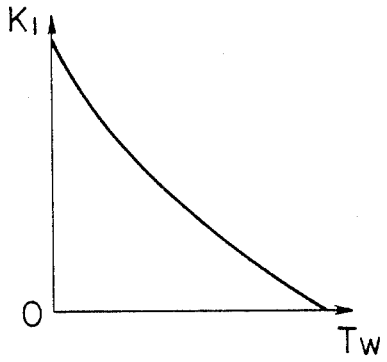
FIGS. 8 to 11 are diagrams for explaining the correction factors.

In a computing block 51, a block 51A calculates a correction factor $K_1$ corresponding to the magnitude of the cooling water temperature $T_w$. FIG. 8 shows its characteristic.

Figure 9:
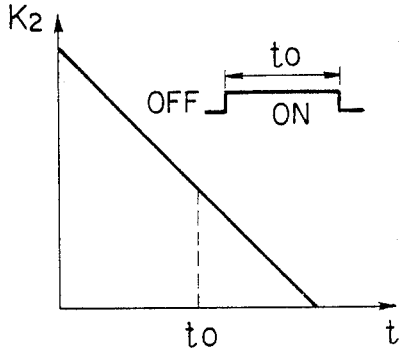

A computing block 51B inputs the position P of the throttle idle position switch to calculate a correction factor $K_2$ corresponding to its magnitude. FIG. 9 shows its characteristic diagram.

Figure 10:
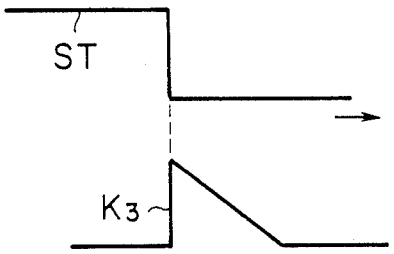

A computing block 51C calculates a correction factor $K_3$ from the starter signal ST (which is on or off). FIG. 10 shows its characteristic diagram.

Figure 11:
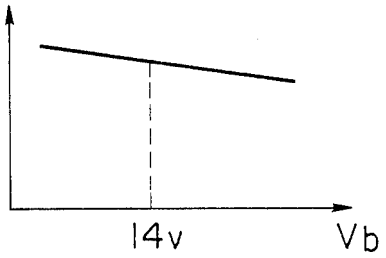

A computing block 51D determines a correction time width $T_s$ corresponding to the magnitude of the voltage $V_b$ of the battery. FIG. 11 shows its characteristic diagram.

A block 51E determines a correction factor K from equation $K=K_1+K_2+K_3$.

In a computing block 52, a computing block 52A inputs the detected values of the cylinder pressure sensor to detect the peak cylinder pressure angle $\theta_{pmax}$ during each engine cycle. During each engine cycle, the peak cylinder pressure angle occurs on the power stroke.

A computing block 52B obtains an average value $\overline{\theta}_{pmax}$ of the peak cylinder pressure angles. A computing block 52C determines whether the peak angle $\overline{\theta}_{pmax}$ during each cycle is greater than the average value $\overline{\theta}_{pmax}$ by more than a tolerance value $\epsilon$ or $(\theta_{pmax}-\overline{\theta}_{pmax})>+\epsilon$. A computing block 52D determines whether $(\theta_{pmax}-\overline{\theta}_{pmax})<-\epsilon$.

A computing block 52E calculates a correction factor $\alpha$. In other words, $\alpha=\alpha$ or the just preceding value is used as the current value if $|(\theta_{pmax}-\overline{\theta}_{pmax})|<\epsilon$, and $\alpha=\alpha-\Delta\theta_p$ or the just preceding value minus $\Delta\theta_p$ is used as the current value when $(\theta_{pmax}-\overline{\theta}_{pmax})>\epsilon$. When $(\theta_{pmax}-\overline{\theta}_{pmax})<\epsilon$, $\alpha=\alpha+\Delta\theta_p$ or the just preceding value plus $\Delta\theta_p$ is used as the current value.

A computing block 55 calculates the actual energization time $T_i$ of the injector from the following equation $$T_i=\alpha(1+K)T_p+T_s \quad (7)$$

In accordance with the thus calculated $T_i$, a pulse of the pulse width corresponding to $T_i$ is sent as a driving signal to the injector driver and the injector is energized for the duration of $T_i$. As a result, the fuel is injected for the time width $T_i$.

It is to be noted that the blocks shown in FIG. 7 can be replaced with the equivalent computer control steps as in the cases of FIGS. 1 to 4.

Figure 12:
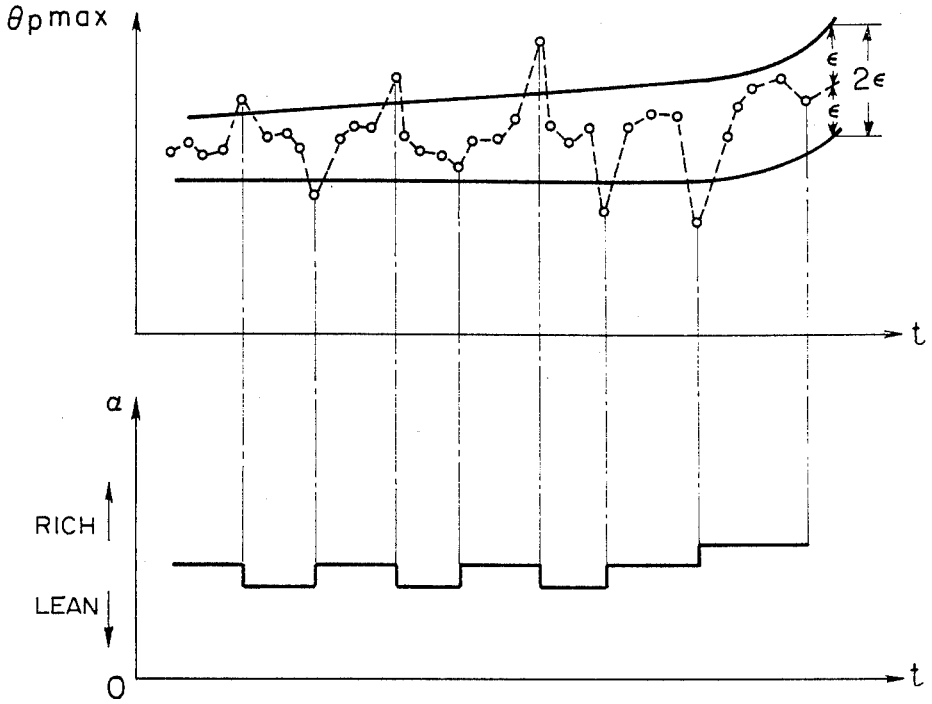
FIG. 12 is a diagram showing an exemplary cylinder pressure control in the embodiment of the invention.
Figure 13:
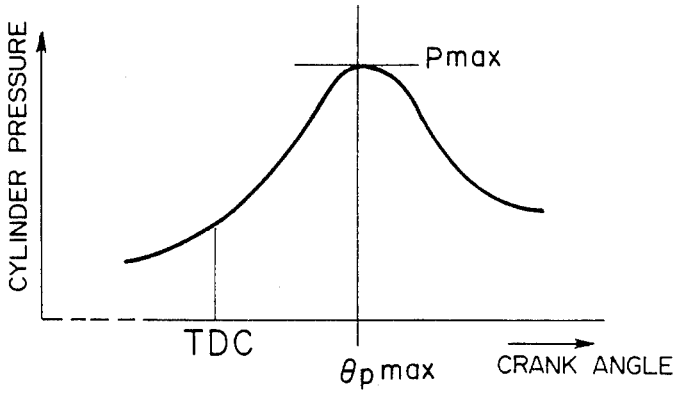
FIG. 13 is a graph for explaining the cylinder pressures.

FIG. 12 shows an exemplary fuel control responsive to variations in the angle of peak cylinder pressure. The peak cylinder pressure angle average value $\overline{\theta}_{pmax}$ itself is varied as shown in the Figure. A tolerance of $\pm\epsilon$ is established for the average value $\overline{\theta}_{pmax}$ so that when the detected peak angle $\theta_{pmax}$ is greater than the average value plus $\epsilon$, the value of $\alpha$ is decreased so that the fuel injection time is decreased and the mixture is made leaner, whereas when the detected peak angle $\theta_{pmax}$ is smaller than the average value minus $\epsilon$, the value of $\alpha$ is increased so that the fuel injection time is increased and the mixture is enriched. FIG. 13 shows the manner in which the cylinder pressure varies.

By this control, the quantity of fuel injected is adjusted depending on the magnitude of the cylinder pressure and the proper fuel control is ensured.

While the invention has been described as applied to a single cylinder engine by way of example, in the case of multiple cylinder engines, e.g., a four cylinder engine, the fuel control is performed for each cylinder of the engine. In addition, the angle of peak cylinder pressure may be detected for each cylinder to effect the fuel control correspondingly for each cylinder, thereby ensuring more accurate control.

Figure 14:
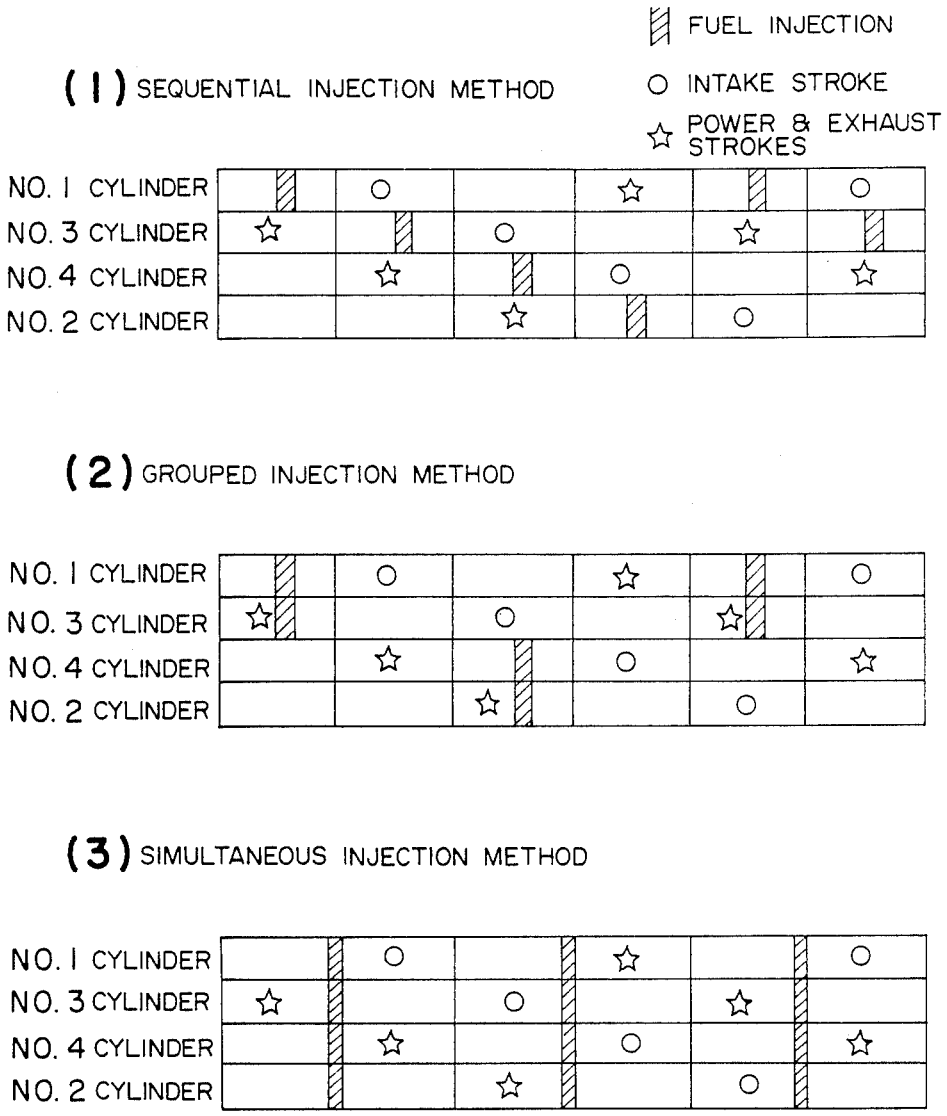
FIG. 14(1)–(3) are diagrams for explaining various fuel injection methods.

FIG. 14 shows some fuel injection control methods. A sequential injection method (1) is one in which the fuel is injected into the individual cylinders one at a time and the injection order of the cylinders is 1→3→4→2→.

A grouped injection method (2) divides the cylinders into two groups (a group of No. 1 and No. 3 cylinders and a group of No. 4 and No. 2 cylinders) so that the injection of fuel into the No. 1 and No. 3 cylinders is effected simultaneously and also the injection of fuel into the No. 4 and No. 2 cylinders is effected simultaneously.

A simultaneous injection method (3) is one in which the injection of fuel into the No. 1 to No. 4 cylinders is effected simultaneously.

The present embodiment can be applied to any one of these methods. It is to be noted that the fuel should preferably be injected on the exhaust stroke in the cases of the sequential injection system and the grouped injection method. In the case of the simultaneous injection method, the fuel should preferably be injected at around the top dead center or the bottom dead center.

We claim:

1. A fuel control system for an internal combustion engine having at least one cylinder with an injector, comprising:

first means for inputting a throttle opening $\theta_{th}$ and an engine speed $N_e$ to generate a basic injection pulse width $T_p$;

second means for detecting a peak value $\theta_{pmax}$ of pressures in said cylinder of said engine during each cycle thereof to calculate an average value $\overline{\theta}_{pmax}$ of said peak values and determine whether a difference $(\theta_{pmax}-\overline{\theta}_{pmax})$ between said average value $\overline{\theta}_{pmax}$ and a peak value $\theta_{pmax}$ during each cycle is within a tolerance $\epsilon$ whereby when said difference is greater than said tolerance a correction factor $\alpha$ is established in a direction tending to decrease said difference;

third means for calculating an injection time $T_i$ of said injector in accordance with said basic injection pulse width $T_p$ from said first means and said correction factor $\alpha$; and fourth means for energizing said injector for the duration of said injection time $T_i$ from said third means.

* * * * *